United States Patent [19]

Fischer

[11] 4,087,149

[45] May 2, 1978

[54] ELECTRICAL PLUG CONNECTIONS

[76] Inventor: Karl Fischer, Am Gaensberg 23, 7519 Oberderdingen, Germany

[21] Appl. No.: 750,783

[22] Filed: Dec. 15, 1976

[30] Foreign Application Priority Data

Nov. 28, 1975 Germany ..... 2553558

[51] Int. Cl.[2] ..... H01R 7/04

[52] U.S. Cl. ..... 339/95 D; 339/244 R

[58] Field of Search ..... 339/244 R, 95 R, 95 D

[56] References Cited

U.S. PATENT DOCUMENTS

| | | | |
|---|---|---|---|
| 3,315,219 | 4/1967 | Brinser et al. | 339/198 R |
| 3,821,693 | 6/1974 | Dechelette | 339/244 R |
| 3,905,671 | 9/1975 | Lechner | 339/244 R |

*Primary Examiner*—Joseph H. McGlynn
*Attorney, Agent, or Firm*—J. Rodman Steele, Jr.

[57] ABSTRACT

A terminal connector for connecting an electrical terminal member, such as a flat plug pin which may be on an electrical component, to an electrical lead comprises a bow-shaped resilient clamping element adapted to be fitted on the terminal member. The clamping element has a base limb which lies flat against the terminal member and which may have a locking projection seated in a hole in the latter. A clamping limb of the clamping element extends obliquely towards the base limb to clamp the electrical lead against the terminal member. The back of the clamping element joining the two limbs has a hole through which the electrical lead is inserted. The lead can be removed by turning it back and forth while applying tension.

21 Claims, 5 Drawing Figures

ELECTRICAL PLUG CONNECTIONS

Figure 1:
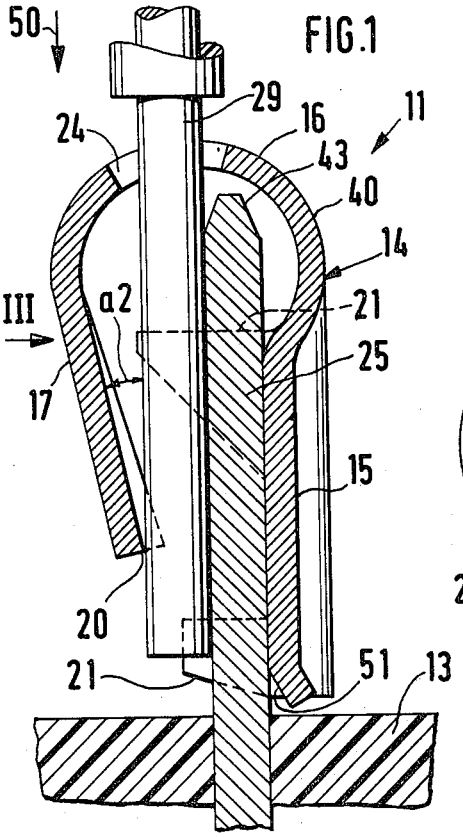

The invention relates to means for connecting a terminal member, such as a flat plug tang on an electrical appliance, switch, connection member or the like, to electrical leads.

A terminal connector for this purpose, as described in German Patent Specification No. 1,246,079, has a bow-shaped resilient clamping member which has a base limb extending parallel outside the terminal member and at least one clamping limb which is directed obliquely in the direction of insertion and which presses the lead against the base limb. The back interconnecting the two limbs has an opening through which the lead to be connected extends. This terminal connector is intended for electrical appliances and is enclosed in a two-part housing, one part of which has an opening through which a releasing tool can be inserted at right angles to the direction of insertion of the lead. The releasing tool presses back the clamping limb which presses against the lead at a very steep angle of approximately 60° and normally prevents the lead from being withdrawn. The necessity of having to use a releasing tool prevents use in all cases in which the connection is not accessible from two sides.

The object of invention is to provide a terminal connector which renders it possible to insert the connection lead in a simple manner and which, despite a satisfactory holding action, is readily releasable as desired.

In accordance with the present invention, a terminal connector for connecting an electrical terminal member to at least one electrical lead comprises a bow-shaped resilient clamping member which has a base limb, at least one clamping limb and a back interconnecting the two limbs, the limbs being adapted to receive the terminal member therebetween with the base limb lying against and parallel to the terminal member, said back having an opening through which the lead to be connected can be inserted so that the clamping limb can clamp the inserted lead against the terminal member, the clamping limb being inclined acutely to the base limb in the direction of lead insertion such as to facilitate lead insertion and to retain the lead, when inserted, and at such a flat angle to the lead when inserted that the lead is removable in the opposite direction to the direction of insertion without using a releasing tool.

The lead can be withdrawn again despite a satisfactory retaining action, particularly if the lead is turned back and forth slightly during removal.

Furthermore, standardized flat pin plug connections are known (AMP connections or LUCAR connections, for example in accordance with German DIN Standard No. 46,247). They have spring plug tangs, that is flat, anteriorly chamfered strips of metal having a central hole. A socket member of such standardized connections is attached to the lead, e.g. by soldering or welding. The socket member comprises a clamping spring of C-shaped cross section i.e. having curled-over edges which embrace the edges of the flat plug tang from the sides when the socket member has been slipped on the tang. Although the flat plug tang can be satisfactorily mounted on a component, and at the same time frequently forms the end of a functional member, such as a switching contact spring, it is difficult to fit the C-shaped clamping spring over the flat plug tang, and the clamping spring needs to have a long installation length.

By using the terminal connector in accordance with the invention, it is possible to retain the standardized, advantageous flat plug tang as the terminal member and to fit the bow-shaped resilient clamping member onto the flat plug tang, the clamping member being fixed on the flat plug tang by means of a stop device and having at least one plug-in clamping device for the lead.

The direct connection of solid wires and braided leads or stranded wires is rendered possible by means of the plug connection. The clamping member is a simple component made from spring material which is manufactured separately from the terminal member (such as a flat plug tang) and the lead. The advantages of the flat plug tang are retained, particularly the standardization and a wide range of use in conventional appliances. On the other hand, the clamping member no longer has to be mounted on the lead by a separate working operation.

Figure 2:
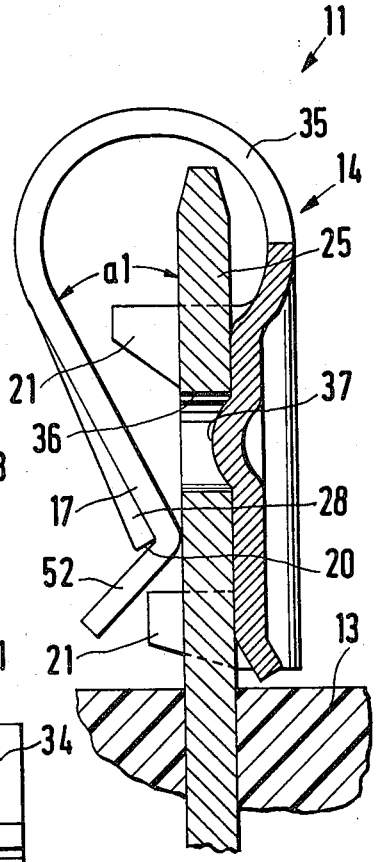
Figure 4:
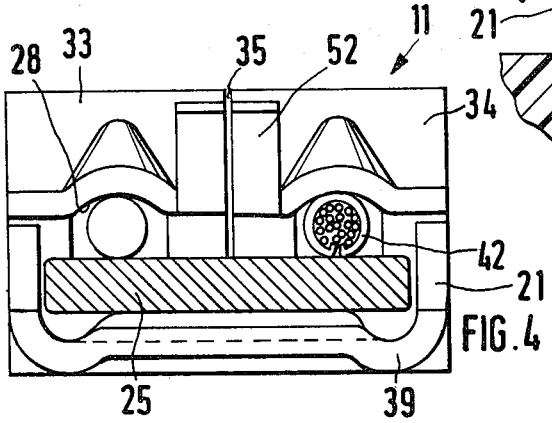
Figure 3:
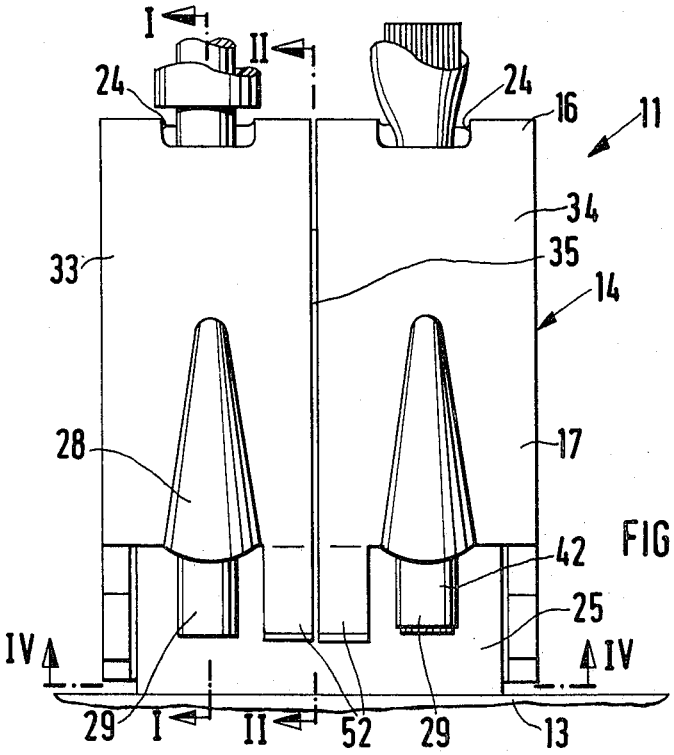
Figure 5:
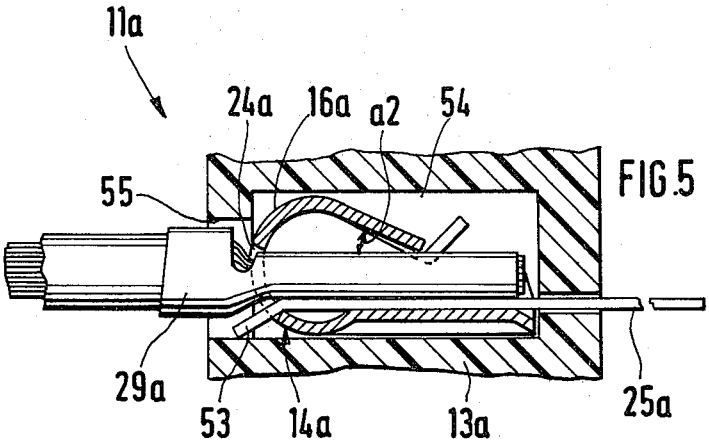

The invention is further described, by way of example, with reference to the accompanying drawings, in which:

FIG. 1 is a longitudinal section (taken on the line I—I of FIG. 3) through a plug connection having a terminal connector in accordance with the invention, and having an inserted lead, FIG. 2 is a longitudinal section taken on the line II—II of FIG. 3, but without an inserted lead, FIG. 3 is an elevation viewed in the direction of the arrow III of FIG. 1, FIG. 4 is a section taken on the line IV—IV of FIG. 3, and FIG. 5 is a longitudinal section through a modification of the plug connection.

FIGS. 1 to 4 show a terminal connector 11 to which is connected a terminal member in the form of a flat plug tang 25, a lead 29 (solid wire) and a lead 29' (stranded wire) having a core-end sleeve 42. A component 13 which carries the flat plug tang 25, and which, in the present instance, is only partially illustrated, may be an electrical appliance, a switch, regulator, connection strip or the like.

The flat plug tang 25 is of conventional and standard construction (AMP plug connection), and comprises an elongate strip of flat material whose free end is chamfered on all sides and which has a transverse hole 36 in the centre thereof.

A clamping member 14 made from flat resilient material is slipped over the flat plug tang 25 and has a base limb 15 which abuts against one flat side of the flat plug tang and which has two bent-up guide portions 21 which embrace the longitudinal narrow sides of the flat plug tang, so that the flat plug tang is guided in the flat groove which is formed. To ensure that the bending radius between the base limb 15 and the guide portions 21 does not impair the abutment of the entire surface of the flat plug tang against the base limb 15, a rearwardly directed groove-shaped bent portion 39 is provided between the base limb and each guide portion. A projection 37 formed in the base limb 15 engages into the hole 36 in the flat plug tang 25 and, acting as a stop device, fixes the clamping member 14 on the flat plug tang.

A rearwardly directed bent portion 40 of a resilient back 16 is contiguous to the base limb 15, which back surrounds the chamfered free end 43 of the flat plug tang substantially semi-circularly and establishes the connection to a clamping limb 17 which is directed obliquely towards the flat plug tang 25. The end 20 of the clamping limb 17 does not extend quite as far as the free end of the base limb 15 which is substantially the same length as the flat plug tang.

As may be seen from FIGS. 2 to 4, the back 16 and the clamping limb 17 are divided into two portions 33, 34 by means of a slot 35 which extends across almost the entire back up to the base limb. Thus, largely independent resilience of the two portions 33, 34 is ensured. Each of the portions 33, 34 has, in the region of the back, an opening 24 which is disposed such that the lead 29 extending therethrough abuts against the flat plug tang 25.

The portions 33, 34 of the clamping limb 17 are dished towards the end 20 to form a groove 28 which extends in the longitudinal direction of the clamping member and partially surrounds the inserted lead 29 and guides the latter. The depth of the curvature increases in the direction towards the free end 20 of the clamping limb. The lateral portions of the clamping limbs abut against the flat plug tang 25 under considerable prestress (FIG. 2), this being possible owing to the bipartite construction of the guide portions 21. The grooves 28 form an insertion gap for centering the lead.

The bow-shaped clamping member 14, punched and bent in one piece from flat spring material, preferably spring steel, ensures that its clamping limb 17 has a very long spring length. This spring length includes the back 16 almost up to the base limb 15 and is rendered possible with the shortest overall length. Thus, despite the large spring force of the clamping limb, the leads 29 can be inserted with only a slight pushing force.

The clamping limb 17 and the back 16 are dimensioned such that the following conditions are fulfilled. The angle between the clamping limb 17 and the base limb (when the clamping member has not been slipped onto the flat plug tang) is less than 50°, preferably approximately 35°. The angle *a*1 between the clamping limb and the flat plug tang (FIG. 2) is less than 45° and is preferably less than 30°. Essentially it depends upon the angle *a*2 between the clamping limb and the surface of the lead for which the clamping member is intended. This angle *a*2 should be less than 40°, preferably between 10° and 25°. This angle ensures that, despite a satisfactory retaining action provided by engagement of the sharp-edge end 20 into the surface of the lead 29, 29', the lead can be released without a special releasing device or tool. It is only necessary to turn the lead 29, 29' slightly back and forth (for example through 30°) whilst applying tensile force in the opposite direction to the direction of insertion (arrow 50). As a result of the rolling of the lead on the flat plug tang in the range of the tolerance (even though it is only slight) of the lead in the clamping member and a certain natural swinging movement of the lead during turning, the sharp edge 20 describes a zig-zag line on the lead until it arrives at the free end of the lead. The relatively flat angle *a*2 specified ensures that the barb effect of the clamping portion 17 does not become too great.

The end surface of clamping limb 17, which defines in part sharp end-edge 20, forms an angle with the surface of the lead 29, which angle is substantially complementary to angle *a*2. That is, the sum of the two angles is approximately 90°. Therefore, when angle *a*2 should be less than 40°, the angle of the end surface should be greater than 50°. When angle *a*2 is preferably between 10° and 25°, the angle of the end surface is preferably between 65° and 80°.

The slipping of the clamping portion 14 onto the flat plug tang is facilitated by a chamfer 51 at the free end of the base limb 15 and a respective tab 52 projecting obliquely from the clamping limb 17 at the end 50. The tabs 52 are arranged adjacent to the slot 35 and outside the guide grooves 28.

As can be seen from FIG. 2, the tab 52 advantageously blends into the clamping limb at a rounded portion. The absence of a sharp edge at this juncture facilitates the pushing of the clamping member 14 onto the tang 25.

The variant illustrated in FIG. 5 uses a clamping member 14*a* which, with the exception of the following modifications, has the same construction and function as those of the clamping member shown in FIGS. 1 to 4 and therefore will not be fully described.

A different, thinner strip-shaped terminal member 25*a* is used instead of the AMP flat plug tang and the opening 24*a* in the back 16*a* is therefore constructed such that the terminal member 25*a* extends therethrough. An outer bent portion 53 fixes the clamping member on the terminal member. Thus, the projection on the base limb is omitted. The terminal connector 11*a* is located in a recess 54 in an insulating member 13*a* of the appliance and is thus fully covered and insulated. The lead 29*a* (a stranded lead embraced by a core-end sleeve) is inserted through an insertion opening 55.

In addition to the illustrated clamping member for the connection of two leads, it is also possible to manufacture such clamping members having only one or a large number of connection possibilities. The terminal connector in accordance with the invention is also suitable for tinned stranded leads without core-end sleeves.

I claim:

1. A terminal connector for connecting an electrical terminal member to at least one electrical lead, comprising a bow-shaped resilient clamping member which has a base limb, at least one clamping limb and a back interconnecting said limbs, said limbs being adapted to receive said terminal member therebetween with said base limb juxtaposed and parallel to said terminal member, said back having an opening through which said lead is adapted to be inserted, said inserted lead being clamped by said clamping limb against said terminal member, said calmping limb having a sharp means for engaging said lead, said clamping limb having a configuration inclined acutely to said base limb in the direction of said lead insertion, and said acutely inclined configuration of said clamping limb being at a relatively flat angle, so that said inserted lead is adapted to be removed in the opposite direction to the direction of insertion without using a releasing tool.

2. A terminal connector according to claim 1 further comprising lateral projection means on the longitudinal sides of said base limb, said projection means being directed towards the clamping limb for laterally guiding said terminal member.

3. A terminal connector according to claim 1, in which said clamping limb comprises at least two parallel resilient portions which are largely independent of one another and which are each adapted to clamp a respective inserted lead.

4. A terminal connector according to claim 1, in which said terminal member is strip-shaped and extends through said opening in said back of the clamping member, said terminal connector having a bent portion where it extends through said opening.

5. A terminal connector according to claim 1, in which said clamping limb is provided at the end thereof with at least one portion which is directed obliquely away from said base limb in the direction of insertion.

6. A terminal connector according to claim 1, in which said terminal member comprises a flat tang having a chamfered free end and a central aperture.

7. A terminal connector according to claim 1, wherein said end surface forms an angle which is nearly 90° with respect to the surface of the inserted lead.

8. A terminal connector according to claim 1, in which said relatively flat angle between the surface of said inserted connection lead and said clamping limb is less than about 40°.

9. A terminal connector according to claim 8, in which said relatively flat angle is between about 10° and 25°.

10. A terminal connector according to claim 1, in which the angle between said clamping limb and said received terminal member is less than about 45° before insertion of said connection lead.

11. A terminal connector according to claim 10, in which said angle is less than 30°, before insertion of the connection lead.

12. A terminal connector according to claim 1 further comprising guide groove means in said clamping limb for guiding said lead during said insertion.

13. A terminal connector according to claim 12, in which said clamping limb is provided at the end thereof with a portion which lies to one side of said guide groove means and which is directed obliquely away from said base limb in the direction of said lead insertion.

14. A terminal connector according to claim 1, in which said resilient clamping member has stop means thereon adapted to co-operate with corresponding stop means on said terminal member for retaining the terminal connector on the terminal member.

15. A terminal connector according to claim 14 and in which said stop means comprises a projection on the base limb extending towards the clamping limb and adapted to be received in an aperture provided in said terminal member.

16. A terminal connector according to claim 1, wherein said sharp means on said clamping limb is a sharply cut edge.

17. A terminal connector according to claim 16, wherein said edge is formed by an end surface of said clamping limb.

18. A terminal connector for connecting a flat plug tang on an electrical component to at least one electrical lead comprising a bow-shaped resilient clamping member adapted to be received on said flat tang and adapted to clampingly receive at least one plug-in lead, said plug-in lead being clamped by a spring action created exclusively by said clamping member, said resilient clamping member having a base limb adapted to lie flat against said flat tang and a sharp means for engaging said lead, and stop means on the clamping member adapted to cooperate with complimentary stop means on the flat tang to retain the terminal connector on the flat tang, said stop means comprising a projection on the base limb adapted to be received in an aperture provided in said flat tang.

19. A terminal connector for connecting an electrical terminal member to at least one electrical lead, which terminal connector is effective without being mounted in a housing, comprising a bow-shaped resilient clamping member which has a base limb, at least one clamping limb having a sharp means for engaging said lead and a back interconnecting said limbs, said limbs being adapted to receive said terminal member therebetween with said base limb juxtaposed and parallel to said terminal member, said back having an opening through which said lead is adapted to be inserted, said inserted lead being clamped by said clamping limb against said terminal member by a spring action, said spring action being created exclusively by the clamping limb and the back, said clamping limb having a configuration inclined acutely to said base limb in the direction of said lead insertion, and said acutely inclined configuration of said clamping limb being at a relatively flat angle, so that said inserted lead is adapted to be removed in the opposite direction to the direction of insertion without a releasing tool.

20. A terminal connector according to claim 19, wherein said sharp means on said clamping limb is a sharply cut edge.

21. A terminal connector according to claim 20, wherein said edge is formed by an end surface of said clamping limb.

* * * * *